US009202358B2

(12) United States Patent
Miao

(10) Patent No.: US 9,202,358 B2
(45) Date of Patent: Dec. 1, 2015

(54) METHOD AND SYSTEM FOR TRANSMITTING VIDEO IMAGES USING VIDEO CAMERAS EMBEDDED IN SIGNAL/STREET LIGHTS

(76) Inventor: Wen Miao, Harthrone, CA (US)

( * ) Notice: Subject to any disclaimer, the term of this patent is extended or adjusted under 35 U.S.C. 154(b) by 774 days.

(21) Appl. No.: 12/025,699

(22) Filed: Feb. 4, 2008

(65) Prior Publication Data

US 2009/0195653 A1 Aug. 6, 2009

(51) Int. Cl.

| | |
|---|---|
| ***G08G 1/04*** | (2006.01) |
| ***G08B 15/00*** | (2006.01) |
| ***G08B 13/196*** | (2006.01) |
| ***G08B 25/06*** | (2006.01) |

(52) U.S. Cl.

CPC ..... *G08B 15/001* (2013.01); *G08B 13/19632* (2013.01); *G08B 13/19656* (2013.01); *G08B 25/06* (2013.01); *G08G 1/04* (2013.01)

(58) Field of Classification Search

CPC ..... G08G 1/04; G08B 13/19656; G08B 25/06
USPC ..... 348/149
See application file for complete search history.

(56) References Cited

U.S. PATENT DOCUMENTS 6,466,260 B1 * 10/2002 Hatae ..... G08G 1/0175 348/149
6,509,832 B1 * 1/2003 Bauer ..... B60Q 1/0023 340/425.5
7,681,000 B2 * 3/2010 Funk ..... G06F 12/1491 711/132
2002/0031120 A1 * 3/2002 Rakib ..... G08B 13/19656 370/386
2003/0163826 A1 * 8/2003 Weinstein ..... G08B 13/19656 725/105
2003/0197807 A1 * 10/2003 Wu ..... G08B 13/19619 348/375
2005/0018766 A1 * 1/2005 Iwamura ..... G08B 13/19656 375/240.01
2005/0134748 A1 * 6/2005 Hoerl ..... H04N 5/208 348/734
2005/0226463 A1 * 10/2005 Suzuki ..... G08B 13/19656 382/103
2006/0050642 A1 * 3/2006 Chini ..... H04L 12/5692 370/241
2007/0013552 A1 * 1/2007 Povey ..... G08G 1/095 340/907
2007/0055988 A1 * 3/2007 Iwamura ..... H04L 12/2803 725/37
2009/0051767 A1 * 2/2009 Iwamura ..... 348/143
2009/0066795 A1 * 3/2009 Wollmershauser .... H04N 7/181 348/159
2009/0278931 A1 * 11/2009 Lee ..... G08B 13/19656 348/143
2010/0020172 A1 * 1/2010 Mariadoss ..... G08B 13/19613 348/143
2010/0026811 A1 * 2/2010 Palmer ..... H04N 7/181 348/159

* cited by examiner

*Primary Examiner* — Anthony Mejia
(74) *Attorney, Agent, or Firm* — Edwin Tarver; Lauson & Tarver, LLP

(57) ABSTRACT

A method and system of video surveillance by using existing street light, traffic light and other household or outdoor light assemblies. A video camera is mounted in the light assembly and is powered through power lines of the light assembly. A converter is used to convert images captured by the video camera into Internet Protocol (IP) video data. A combiner then combines the IP video data into the power stream for transmission through the power lines. Both the converter and the combiner are housed in the light assembly. The IP video data travels through the power lines and is separated from the power stream at a collection point. The separated IP video data is transmitted wirelessly or through existing cables over the Internet for viewing.

16 Claims, 5 Drawing Sheets

METHOD AND SYSTEM FOR TRANSMITTING VIDEO IMAGES USING VIDEO CAMERAS EMBEDDED IN SIGNAL/STREET LIGHTS

CROSS-REFERENCE TO RELATED APPLICATION

None

FEDERALLY SPONSORED RESEARCH

Not Applicable

SEQUENCE LISTING OR PROGRAM

Not Applicable

STATEMENT REGARDING COPYRIGHTED MATERIAL

Portions of the disclosure of this patent document contain material that is subject to copyright protection. The copyright owner has no objection to the facsimile reproduction by anyone of the patent document or the patent disclosure as it appears in the Patent and Trademark Office file or records, but otherwise reserves all copyright rights whatsoever.

BACKGROUND

The present invention relates in general to methods and systems for video transmission and recording, and more particularly to a method and system of recording and transmitting video images over existing power lines by using cameras associated with street lights, traffic lights, ceiling lights, and the like. In general, the present invention provides a method and system to integrate a video camera into an existing light assembly, including traffic lights, street lights, ceiling lights, etc.; enable video images from the camera to be transmitted over existing light assembly power lines, thereby obviating the need for dedicated video transmission cables, using an internet-based protocol such as Internet Protocol (IP) or other video transmission protocols for transmitting video over power line, and provide access (secured or unsecured) of video images over the Internet, wide-area networks (WAN's), or local-area networks (LAN's) at one or more viewing locations for surveillance, monitoring, and/or recording purposes.

In general, video surveillance requires a video camera to be mounted at a particular location, and images to be transmitted by the video camera to a central location via secondary wiring. A variety of video surveillance systems have been developed in art. U.S. Pat. No. 6,466,260 to Hatae discloses a traffic surveillance system having at least one traffic signal light, a television camera and a television monitor for displaying a video signal from the camera. The traffic signal light apparatus comprises traffic signal lights, a first controller for controlling traffic signal lights, a housing in which traffic signal lights are installed, and a second controller coupled to the first controller, the television camera and the monitor. The video image from the television camera and lighting information of each light of the traffic signal lights from first controller are superimposed and displayed on the monitor.

U.S. Pat. No. 5,432,547 to Toyama discloses a device for traffic monitoring device which includes a television camera for imaging a road, a vehicle movement measuring instrument, a signal state detector for detecting an indication color of the signal lights. The vehicle movement measuring instrument processes image data from the television camera and measures traveling position and traveling speed of each vehicle. When a vehicle disregards a red indication of the signal lights, it is detected and a recorder records its traveling state and registration number. The device also includes a transmitting means for transmitting alerts to a police station when the vehicle disregards the traffic signal. Although the above devices use video cameras associated with traffic lights, there are no methods and systems involved in transmitting recorded video images through internet protocol over existing power lines.

U.S. Pub. No. 20030197807 to Wu discloses a method for forming a light bulb adapter camera system. The system comprises a housing and a data processor having an interface to accept digital image information and an output to supply network formatted digital image information. The system also includes a light bulb compatible screw base for mounting the camera adapter in a light bulb socket and for accepting AC current. The network formatted digital image information can be supplied in a wireless format or in a power line network format via the AC current line. Although data can be transmitted through the AC current lines, the present invention still defers in that it can be employed with any existing light assemblies such as street lights and traffic lights. Moreover, the present invention uses additional systems for enhancing the transmission and viewing aspects of recorded video data.

The object of the present invention is to provide a method and system of video surveillance that can be used with existing street light assemblies, traffic light assemblies, and the like. The present invention discloses a combination of lighting and video surveillance without the use of specially designed light and video assemblies. Currently, in order to provide video surveillance at a traffic light, a separate installation, including a video camera along with its associated accessories including outdoor mounting hardware, video transmission cables, and power transmission cables is required. These installations are expensive and time consuming to maintain. In the present invention, there is no need for installation of special mounting hardware or special cabling (for video or power) to support the camera. The present invention uses the existing lighting assembly for the physical camera mount and the existing light assembly's power lines for transmitting power and video to and from the camera.

A further object is to transmit recorded video images through Internet Protocol, or other video transmission protocols, over existing power lines used by the street lights, traffic lights, ceiling lights and the like, thereby eliminating the need for separate network cables for video data transmission. Also, existing power lines are used to power the camera. These and other objects of the present invention will become better understood with reference to the appended Summary, Description, and Claims.

SUMMARY

The present invention is an improved video camera light system for conducting video surveillance by using existing light assemblies such as street lights and traffic lights. The present invention uses the existing power source of the light assembly as the medium for transmitting recorded images, including the power lines connected to the light source. In a preferred embodiment of the present invention, a video camera is mounted to the housing of a street light or traffic light. In another preferred embodiment, the video camera is directly incorporated into the light bulb of a traffic light or steel light. When an image or series of images is captures by the camera, the recorded images are converted into Internet Protocol video data, which is then combined with the power stream and transmitted via the power lines that power the light source. The images are converted into IP data immediately after they are captured by the camera. In another embodiment, the recorded images may travel the length of the light pole in raw video format over the power lines, and then be converted into IP data at a downstream collection point. The Internet Protocol video data is separated from the power lines and transmitted via local-area networks (LAN's), wide-area networks (WAN's), or Internet to one or more viewing locations for surveillance, monitoring and/or recording purposes.

FIGURES—REFERENCE NUMERALS

Figure 1:
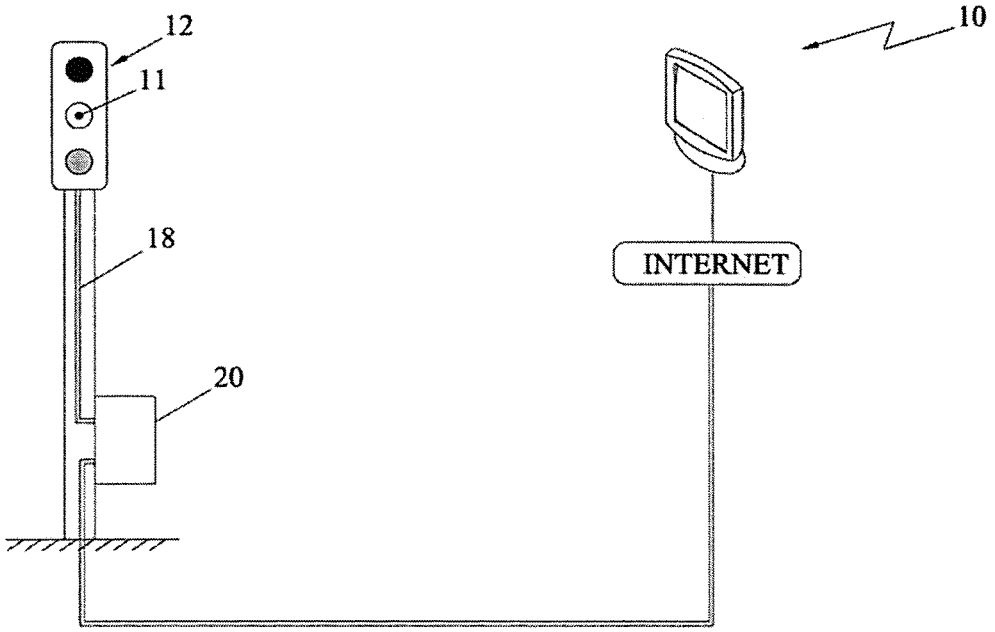
FIG. 1 is a block diagram of a first embodiment of the system of the present invention.

10 . . . System of the Present Invention
11 . . . Video Camera
12 . . . Traffic Light
13 . . . Faceplate
14 . . . Front Cover
15 . . . Protective Visor
16 . . . Converter
17 . . . Combiner
18 . . . Power Line
19 . . . Traffic Light Housing
20 . . . Collection Point
21 . . . Street Light

DETAILED DESCRIPTION

Referring to the drawings, preferred embodiments of the light emitting camera system 10 of the present invention are shown and described. The present invention uses a video camera mounted to a street light or a traffic light and uses existing power lines that power these lights for transmitting images recorded by the video camera.

Figure 2:
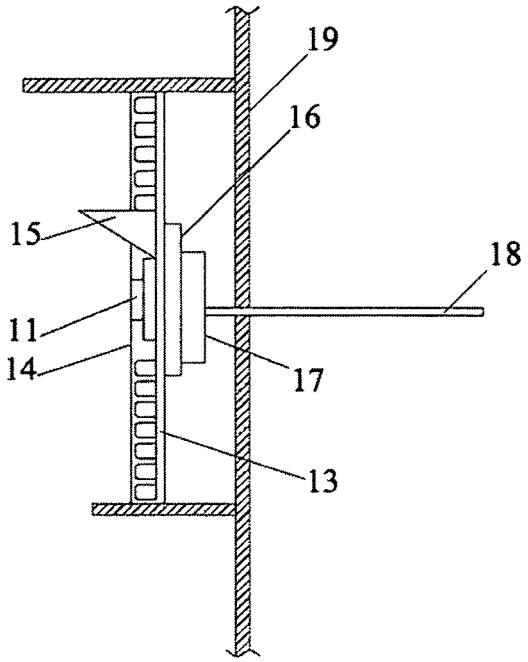
FIG. 2 is a partial sectional side view of the traffic light with the video camera mounted to light bulb face plate in accordance with the present invention.

Referring to FIGS. 1 and 2, according to a first embodiment of the present invention, the video camera 11 is installed on a traffic light 12. The video camera 11 is mounted to a light bulb faceplate 13 of the traffic light and is powered by the electric current that powers the light bulbs. The lens portion of the video camera 11 is positioned inside the front cover 14 of the traffic light 12. The video camera 11 is mounted such that it can be adjusted for selecting a viewing area and can be removed for maintenance purposes. A built-in protective visor 15 for the lens portion is provided in the video camera 11. By employing lens filters, including image enhancing software with the video camera, recorded images can be processed in order to offset external light effects.

The images or videos recorded by the camera 11 are first converted into digital signals, which are further converted into Internet Protocol video data by a converter 16. A combiner 17 is used to integrate the Internet Protocol (IP) video data into the power stream for transmitting the Internet Protocol video data through the power lines 18. The converter 16 and the combiner 17 are housed inside the traffic light housing 19, as seen in FIG. 2. The IP video data travels through the power lines 18 until the collection point 20, where the video data is separated from the power stream. The collection point may be located either on the lighting structure or at a nearby location; for instance, at an intersection, or at the location where the timing for the traffic signal light is located. The separated IP video data is transmitted via local-area networks (LAN's), wide-area networks (WAN's), or Internet using existing network cables or wirelessly to one or more viewing locations for surveillance, monitoring, and/or recording purposes. Video data can be viewed over the Internet by accessing a hosting website.

The recorded images or videos can be converted into IP data immediately after they are captured by camera. In another embodiment, the images may travel the length of the light pole in raw video format over the power lines, and then be converted into IP data at the collection point 20. The transmission can be divided into at least three stages. The first stage includes transmitting the video from the camera to the end of the light structure and to the collection point 20.

The collection point serves many purposes, including: collecting, aggregating, routing and/or pre-processing video data from one or more nearby video camera data, boosting signals for enabling the IP video data to travel long distances while maintaining signal quality and connecting the video stream to a downstream location for viewing at one or more locations for surveillance, monitoring, and/or recording purposes. In an alternate embodiment, instead of using a converter in the traffic light housing, the collection point can also serve the purpose of converting raw video stream to IP video data stream if the camera images are transmitted from the camera to the collection point using video over power line protocol.

The second stage includes transmitting the separated video data from the collection point to existing downstream local-area networks (LAN's), wide-area networks (WAN's) and/or Internet using existing data transmission infrastructure such as data cabling or wireless technology. The third stage includes transmitting the video stream from the Internet to one or more viewing locations anywhere in the world.

At any of these of these stages, the video camera and images may be controlled and manipulated for system management, maintenance and support purposes.

Figure 3A:
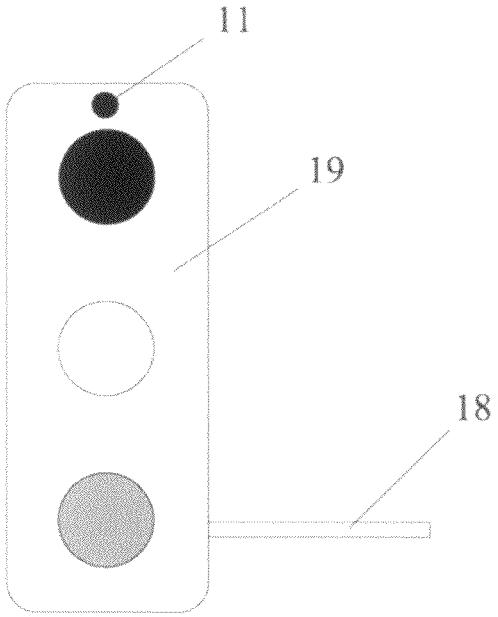
FIGS. 3A and 3B are illustrations of a traffic light with the video camera mounted at different locations on the traffic light housing in accordance with the present invention.
Figure 3B:
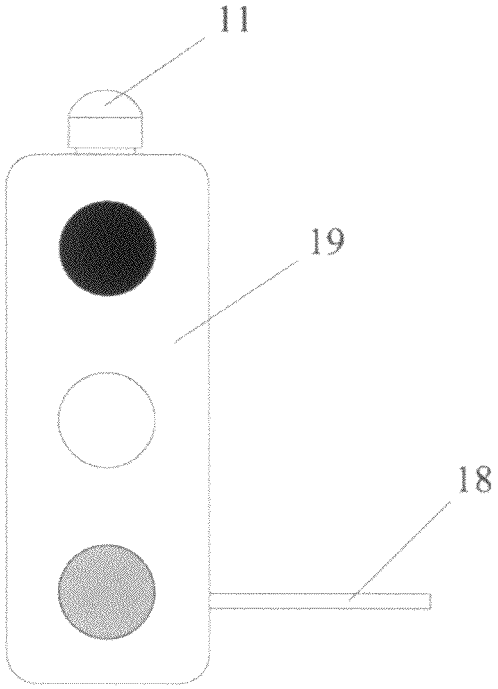

Referring to FIGS. 3A and 3B, instead of mounting to the face plate 13, the video camera 11 can be mounted at any location of the housing 19 of the traffic light 12. This provides extra room for the camera 11 to incorporate features such as tilt, pan and zoom. The video camera 11 can be included inside the housing 19 as seen in FIG. 3A or mounted over the housing 19 as seen in FIG. 3B.

Figure 4:
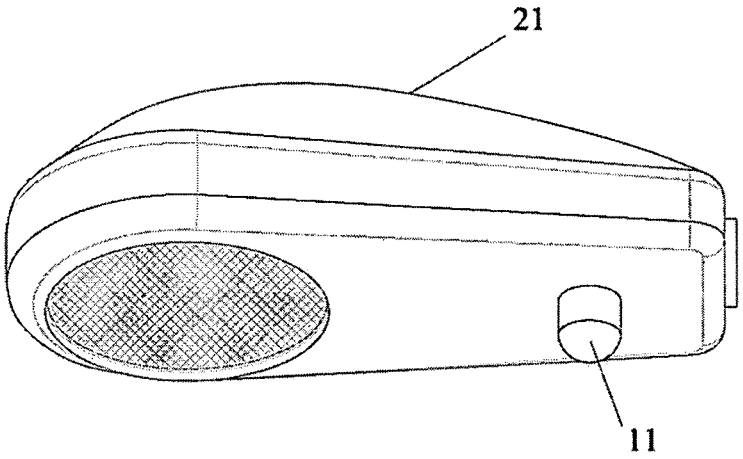
FIG. 4 is an illustration of a street light with the video camera in accordance with a second embodiment of the present invention.

Referring to FIG. 4, a second embodiment is similar to the first embodiment, except that the video camera is mounted in a housing of a street light 21. Preferably, the camera 11 is mounted such that its view is over the lighting area of the street light 21 to make the system of the present invention suitable for even nighttime surveillance. The converter and combiner are also mounted in the street light housing.

The present invention can also be employed with ceiling lights and other indoor and outdoor light assemblies. The combination of the video camera and existing light assemblies along with the use of power lines of the light assemblies for transmitting video images eliminates the need for network cables to link the cameras and other exhaustive setup generally needed for setting up a typical video surveillance system.

In one preferred embodiment of the present invention the data communicated by the camera can be encrypted at any point along the transmission to the viewer. This includes encrypting videos captured by the camera. It is also possible to encrypt the video data at the viewing station of a user, to avoid an encryption means at the site of the camera. The encryption means contemplated, may include, but is not limited to encoding and decoding the video data.

In addition to encryption, in another preferred embodiment of the invention, the video data may be decompressed to use less bandwidth in transmission. The captured video can be recorded, post-processed, or manipulated by authorized personnel.

All features disclosed in this specification, including any accompanying claims, abstract, and drawings, may be replaced by alternative features serving the same, equivalent or similar purpose, unless expressly stated otherwise. Thus, unless expressly stated otherwise, each feature disclosed is one example only of a generic series of equivalent or similar features.

Any element in a claim that does not explicitly state "means for" performing a specified function, or "step for" performing a specific function, is not to be interpreted as a "means" or "step" clause as specified in 35 U.S.C. §112, paragraph 6. In particular, the use of "step of" in the claims herein is not intended to invoke the provisions of 35 U.S.C. §112, paragraph 6.

Although preferred embodiments of the present invention have been shown and described, various modifications and substitutions may be made thereto without departing from the spirit and scope of the invention. Accordingly, it is to be understood that the present invention has been described by way of illustration and not limitation.

What is claimed is:

1. A video surveillance system using existing street lights, traffic lights and other existing household or outdoor lighting infrastructure, comprising:

a video camera incorporated into an LED array of a traffic signal light, such that the video camera lens is encircled by the LED array, said video camera powered by an electric current that powers the traffic signal light;

the video camera capable of convening videos captured by the video camera into protocols for video data transmission, comprising Internet Protocol (IP), wherein the video camera is powered by power lines of the light assembly; and the video camera capable of combining the IP video data into a power stream for transmission over the power lines and separating the IP video data from power stream for transmission to one or more viewing locations for surveillance, monitoring and recording purposes.

2. The system of claim 1, wherein the system combines the Internet Protocol video data into power stream within the light assembly.

3. The system of claim 1, wherein the IP video data is separated from the power stream at a collection point.

4. The system of claim 3, wherein the collection point is on or near a lighting structure pole.

5. The system of claim 3, wherein the separated IP video data is boosted, at the collection point, for long distance transmission.

6. The system of claim 3 wherein the IP video data is encrypted at the collection point.

7. The system of claim 3, wherein the collection point receives and collects the IP video data traveling through power stream from a plurality of light assemblies, with the cameras for transmitting, the IF video data to a central base station, thereby reducing, the number of network nodes required to backhaul video data to the central base station, either on the LAN or WAN network.

8. The system of claim 1, wherein signals comprising the IP video data are boosted fear long distance transmission.

9. The system of claim 1, wherein the separated video data is transmitted to existing downstream local-area networks (LAN's), wide-area networks (WAN's) including the Internet using existing data transmission infrastructure such as data cabling or wireless technology.

10. The system of claim 1 wherein a means for converting videos captured by the camera into IP video data and a means for combining the IP video data into the power stream are housed in the tight assembly.

11. The system of claim 1, wherein the images captured by the camera are processed to offset external tight effects by employing lens filters, including digitally enhancing the images.

12. The system of claim 1, wherein the camera is a video camera having tilt, pan, and zoom capabilities.

13. The system of claim further comprising the step of encrypting the IP video data.

14. The system claim 1 further comprising the step of encrypting the IP video data a user viewing station.

15. The system of claim 1 wherein the IP video data is encoded and decoded.

16. The system of claim 1 wherein the IP video data is compressed and decompressed.

* * * * *